US005138738A

United States Patent [19]

Nicholson

[11] Patent Number: 5,138,738

[45] Date of Patent: Aug. 18, 1992

[54] COATING APPLICATOR WITH REMOVABLE COVER

[76] Inventor: Stephen D. Nicholson, 9 McClure Crescent, Kanata, Ontario, Canada, K2L 2H1

[21] Appl. No.: 649,916

[22] Filed: Feb. 1, 1991

[51] Int. Cl.[5] ..... A47L 13/16

[52] U.S. Cl. ..... 15/247; 15/228; 15/231

[58] Field of Search ..... 15/247, 228, 231

[56] References Cited

U.S. PATENT DOCUMENTS

| | | | |
|---|---|---|---|
| 224,913 | 2/1880 | Hollwede | 15/247 |
| 897,286 | 9/1908 | Haskell | 15/247 |
| 2,304,127 | 12/1945 | Stetson | 15/247 X |
| 2,526,119 | 12/1950 | Cravis | 15/247 X |
| 2,875,460 | 3/1959 | Legge | 15/247 X |
| 4,945,599 | 8/1990 | Flynn | 15/247 X |

*Primary Examiner*—Chris K. Moore

*Attorney, Agent, or Firm*—Stanley E. Johnson

[57] ABSTRACT

A paint brush or the like coating applicator having the coating applying portion thereof encompassed in a removably mounted bag made of cloth. The bag has an open end that is detachably secured to the head of the brush. A rolled or enlarged edge on the open end of the bag serves as a drip collar. A film strip or plate member device is provided to facilitate inserting the brush into the bag.

9 Claims, 2 Drawing Sheets

COATING APPLICATOR WITH REMOVABLE COVER

FIELD OF INVENTION

This invention relates to improvements in coating applicators and more particularly to a paint, varnish, or stain, applicator in combination with a bag-like cover of cloth or cloth like material detachably mounted thereon the advantages and improvements of which will become apparent hereinafter. The invention also relates to a bag like cover for a brush coating applicator and an aid facilitating insertion of the brush into the bag.

BACKGROUND OF INVENTION

A brush is the most common form of coating applicator used by amateurs and professionals to paint objects, walls and the like. A number of attempts have been made to improve on the simple applicator facilitating the use thereof and improve on the application of the coating to the object. One aim is to provide a surface finish on the applied coating that is smooth with complete coverage simulating what might be attained by way of a spray system. Spray systems, however, are expensive and therefore not available to everyone and furthermore not all jobs are suited to paint spraying, for example, the interior walls of a house.

Improvements of hand-use applicators for coatings include paint pads, paint rollers and the like but the most common coating applicator still is the paint brush. Paint brushes can be relatively cheap or relatively costly and there is some correlation between the cost of the paint brush and the quality of use and coating applied. Paint brushes, particularly cheap ones, have annoying traits that include (1) loss of fibres during painting that mar the finish and require messy removal and rework; (2) dripping and running of the coating material down the handle leading to a messy situation and additional clean up time and effort; and (3) drying of the coating material at the base of the fibres leading to reduced reservoir capacity. This latter drawback also results in dried particles often breaking off and marring the coating applied.

For the purpose of obtaining a smoother finish on the applied coating foam applicators have been provided but they too have numerous drawbacks which include loss of foam particles during use which mars the surface finish and are next to impossible to remove or detect during application of the coating. Foam applicators also generally are of the type for example illustrated in Ginter's U.S. Pat. No. 3,105,263 issued Oct. 1, 1963, which includes a relatively rigid center piece projecting from the handle into the interior of the applicator. This gives rise to a very stiff applicator making it difficult to use as well as making it difficult to apply an even coating because of being unable to dispense liquid from the reservoir, provided by the sponge, at a uniform rate during use. Sponge applicators also have a tendency to lose their body integrity when holding a supply of liquid.

The basic functions of hand used coating applicators i.e. paint brushes, paint rollers, paint pads, etc. is to act as a temporary reservoir for a small quantity of the coating material to be applied. The reservoir capacity should be large enough to enable a coating to be applied reasonably effectively and cover a reasonable surface area with each charge but should be small enough to ensure that the coating does not dry out too much on the applicator between charges. Another basic function is to provide control so that the coating applied gets only on the desired area. A further function of the applicator is to spread the coating in a thin smooth film. Paint brushes, particularly cheap brushes, have a tendency to leave brush marks and/or loose fibres but they do have relatively good reservoir characteristics.

Applicators use the capillary action of fibres, or sponge as the case may be, to act as a reservoir. The coating material is drawn up into the fine tubes formed between adjacent fibres or into the air bubbles of a sponge (foam material).

The coating in this reservoir is then drawn out by a squeezing action and by contact between the fibres/-foam and the object's surface as the applicator is drawn across the object being coated. The spread is determined by the pressure of application and the length and rigidity of the fibre/foam. With fibres of usual length very little pressure is required to cause adjacent fibres to part and spread. This characteristic is of course used to advantage. The amount of pressure varies the spread and consequently the coverage.

The brush is used to control and there should be a clear line of distinction between the coated and uncoated area. The degree of control which can be achieved is again dependent on the pressure applied, the length and rigidity of the fibres and the quality of the brush and the fibres used therein.

The spreading action of the brush attempts to produce a coating which is smooth and of even thickness. However, the area of the brush in contact with the object is not entirely flat and smooth and this fact results in brush marks being left in the coating. The degree of unevenness or the depth of the brush marks is dependent on the fineness or coarseness of the fibres (i.e. the diameter of the fibres or the size of the air bubbles in the case of a foam applicator) and on the viscosity and drying time of the coating material. The larger the fibre or bubble diameters and the more viscous and quicker drying the coating material, then the greater the degree of unevenness or brush marks left in the coating.

With brushes there is a trade-off between reservoir capacity and spreading capability and the available control of the coating application. Where the fibres are longer the reservoir capacity and spreading capacity is greater but the degree of control is lessened because the stiffness of the brush is lessened, other things being equal. In the extreme the brush would become more like a mop and there would be little control over where the coating is applied.

There is a further trade-off in size and density of fibre between the smoothness and evenness of finish and the cost of the brush.

Foam applicators tend to produce a smoother finish than fibre brushes but they also tend not to have the rigidity of fibre brushes and therefore do not provide the degree of control and ease of use provided by fibre brushes. Brushes, both fibre and foam, also have a tendency to accumulate dried coating, especially towards the base of the fibres/foam. This can make the brush difficult or impractical to clean thoroughly and this accumulation can reduce reservoir capacity and ease of use of the brush. This coating of dried material can also result in dried coating particles coming adrift from the brush and marring the finish as much or more than fibres or foam particles which come adrift.

One of the major disadvantages and annoyances of using fibre brushes is fibres which come adrift and are left behind on the object's surface, thereby completely spoiling a fine finish or requiring tricky and messy removal of the loose fibre and resmoothing with the brush. If the loose fibre is not removed before the coating material has started to dry significantly its removal can be very difficult and have a very damaging affect on the appearance of the finish and will probably necessitate a re-sanding and a further coat to achieve desirable results.

The wear capabilities of foam applicators are very limited and after a fairly short period of use they tend to begin falling apart, leading to foam particles coming adrift and causing as many or more problems than fibre loss in fibre brushes.

A further problem which can occur with brushes is that of dripping and of coating material running down the handle. This can lead to the brush handle becoming first slippery, then sticky and in both cases, very messy. This makes the brush difficult and uncomfortable to use. This problem can of course be avoided with care; but this requires a higher level of skill on the user's part and the need for this level skill makes the coating implement less user friendly. Where coatings are being applied above the head or at a high angle to the user, this particular problem can indeed be quite irksome.

Applicant's present invention is particularly limited to coating applicators, for example, paint, varnish and stain where the coating applied is in liquid or equivalent form hardening after application into a durable functional and neat appearing, aesthetically pleasing coating. The term "coating applicator" is used herein to describe applicant's device distinguishing it from known washing, cleaning and scrubbing devices. As will be seen hereinafter the present invention is basically a coating applicator with the reservoir coating applying portion thereof encased in a removable cover in the form of a bag made of suitable material to allow the liquid to be appropriately dispensed and spread during application of the coating to an object.

Applicant is aware of scouring and washing devices that utilize a removable cover and attention is particularly directed to the teachings of Gravis U.S. Pat. No. 2,526,199 issued Oct. 17, 1950; Flynn U.S. Pat. No. 4,945,599 issued Aug. 7, 1990, and Goodloe U.S. Pat. No. 2,140,578 issued Dec. 20, 1938. Of interest is also the teachings of Daley U.S. Pat. No. 3,200,427 issued Aug. 17, 1965 and Santana U.S. Pat. No. 2,485,068 issued Oct. 18, 1949.

While some of these patentees disclose a liquid reservoir in the form of a sponge or the like on the end of a handle and wherein the sponge is covered by a removable bag of cloth fabric none have in any way appreciated the attributes of such combination to the art of painting.

SUMMARY OF THE INVENTION

A principle object of the present invention is to improve the functional effect of coating applicators by limiting or reducing some of their functional deficiencies while still maintaining their positive functional attributes.

The invention is very simple and comprises a liquid coating applicator with a removable covering in the form of a bag of suitable material and means for retaining the bag on the applicator. The coating applicator is preferably a brush and the term "brush" hereinafter is used in the sense that it is generic to both bristle type paint applicators and foam type applicators. The term fibre brush and foam brush hereinafter will be used to designate brushes that have respectively fibres and foam material for retaining the coating and applying it to the object being coated.

In accordance with applicant's invention a brush is inserted into essentially a form fitting bag and drawstrings or Velcro TM fasteners or elastic material or elastic bands are used to hold the bag in place over the brush. The elastic band can provide a secondary function of preventing drip, i.e. a drip collar.

The form fitting cover retains any loose fibres or foam particles within the cover and thereby virtually eliminates this drawback associated particularly with cheaper and/or much used brushes.

The form fitting bag cover also provides a disposable outer surface where coating material can accumulate and dry out without materially affecting or adversely affecting the reservoir qualities of the brush and also can readily be disposed of.

The form fitting cover also constrains the spread of the fibres of a fibre brush and thus provides substantially better control for application of the coating to the object and particularly along the edges of the spread which so often is otherwise spoilt by loose or unruly sticking out fibres on a fibre brush.

The cover also tends to reduce the problem of dripping from the brush by providing a greater and more continuous surface area of the brush material to retain excess liquid coating material.

The collar preferably includes a rolled or gathered edge at the top or if desired the addition of further absorbent material to soak up liquid which runs back down towards the handle particularly during overhead use. This rolled edge and/or elastic band fastening means serves as a drip collar improving the functional use of the applicator.

The covering material can be selected to provide desired characteristics and is so chosen as to not impact on the functional attributes of the brush. Particularly the material should be selected so as not to adversely affect the flexibility or the rigidity of the fibres or foam as the case may be and should not significantly affect the reservoir capacity of the brush. The selection of materials will vary depending upon the object to be coated and the characteristics desired. For example, hard wearing materials are used for the form fitting cover where the brush is to be used on abrasive surfaces such as wall board. Less durable material may be used for fine surface finishes. The possibility also arises of using different materials for the cover dependent upon the texture or surface finish one might desire in the applied coating, for example, corduroy material can be used to create a grooved effect and further selection for various groove sizes. On the other hand fine material such as, for example, cheesecloth will leave a finish of near spray quality without the expense and without the environmental impact and wastage of spray devices.

LIST OF DRAWINGS

The invention is illustrated by way of example in the accompanying drawings wherein.

DETAILED DESCRIPTION OF PREFERRED EMBODIMENT

Figure 1:
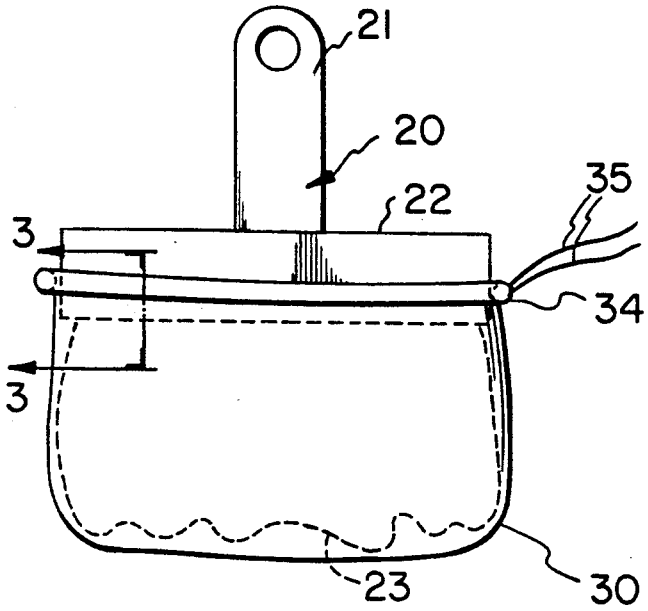
FIG. 1 is a front elevational view of a bristle type paint brush in combination with a form fitting cover therefor provided in accordance with the present invention.

Referring to the drawings there is illustrated in FIG. 1 a fibre paint brush 20 consisting of a handle 21 with a head 22 on which there are mounted fibres 23. In accordance with the present invention a bag 30 is detachably mounted on the head 22 and entirely covers the fibre portion 23. For the sake of illustration the bag is shown loose around the fibres but in reality is in close fitting relation therewith conforming to the outline configuration of the body of fibres. The form fitting bag is detachably mounted on the head 22 by suitable means such as a drawstring, Velcro TM fasteners, elastic bands or the like.

Figure 3:
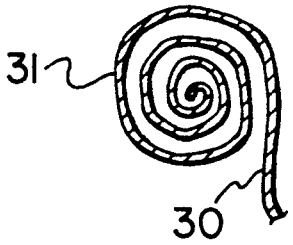
FIG. 3 is an enlarged partial sectional view essentially along line 3—3 of FIG. 1.
Figure 4:
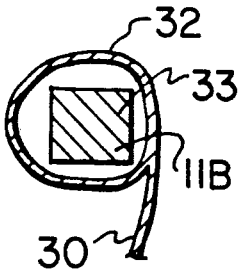
FIG. 4 is similar to FIG. 3 illustrating a variant thereof.

In a preferred form the bag 30 has a rolled edge 31 as illustrated in FIG. 3 or partly rolled as indicated at 32 in FIG. 4 with an annular ring of a body of absorbent material 33 covered by the part rolled edge. If desired the body of absorbent material 33, in the form of a closed loop, can be of an elastic material or confined in an elasticized material to tightly embrace the head 22 and thereby hold the bag on the brush. Alternatively at least the top portion of the bag can be of an elasticized material and of an opening size as to tightly and snugly fit on to the head of the brush holding the bag in position. In the simplest form the bag 30, as viewed in FIG. 1, has a rolled top edge 34 covering a drawstring 35 that extends around the head of the brush.

The material for the bag may be a woven, knit or felted cloth dependent upon the desired wear and coating surface characteristics desired. The cloth may be fine or coarse, thick, or thin, again dependent upon an individual's desired characteristics. A bag made of hosiery or panty hose material has been found to provide excellent all round use results. Fine woven materials are preferred and cheesecloth-like materials provide good results. If desired the bag can be made of a stretch material. Also if desired the bag can be made of cellulosic or paper-like materials. Knitted or woven synthetic yarn materials are durable and leave a clean and smooth surface to the applied coating.

Figure 5:
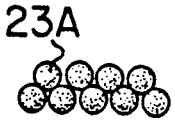
FIG. 5 is a diagrammatic cross-sectional view through the bristles of a brush.
Figure 6:
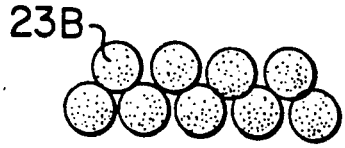
FIG. 6 is similar to FIG. 5 illustrating bristles of larger diameter.
Figure 7:
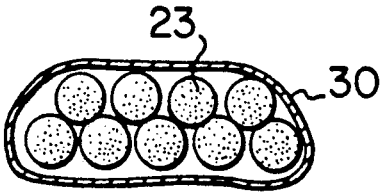
FIG. 7 is similar to FIG. 6 but wherein a form fitting cover surrounds the bristles in accordance with the present invention.
Figure 8:
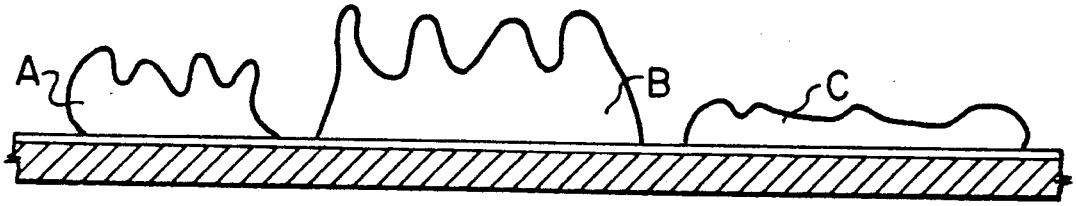
FIG. 8 is a diagrammatic sectional view through coatings applied by the respective example brushes of FIGS. 5, 6 and 7.

FIGS. 5 and 6 are cross-sectional views diagrammatically illustrating the diameter of different fibres in a fibre type paint brush and the surface roughness and thickness of coating for these respective brushes are shown respectively at A and B in FIG. 8. FIG. 5 illustrates bristles or fibres 23A that are relatively small in diameter compared to the fibres or bristles 23B shown in FIG. 6. The applied coating in FIG. 8, designated C, is substantially smoother than either coatings A or B and substantially thinner and represents a coating applied utilizing a coarse bristle brush with a form fitting bag cover in accordance with the present invention.

Applicant's coating applicator not only is applicable for painting but also renders paint brushes suitable for applying stains, brushes heretofore being considered unsuitable for such task. Varnishes can also be applied with a substantially smoother surface than is possible with a bristle brush and in any paint application a smoother coating means the coating can be thinner while at the same time still giving good coverage on the surface to which it is applied.

While the foregoing relates to brushes (bristle or foam), cloth covers can be used or rollers, pads, and other coating applicators.

As previously indicated the bag 30 is preferably in close fitting relation with the body of bristles of the brush. Because of the close fit it is difficult to insert the brush into the bag. Without any form of aid the bag can be rolled on like a stocking. If the bag is made of stretchable material the task is somewhat easier.

Figure 9:
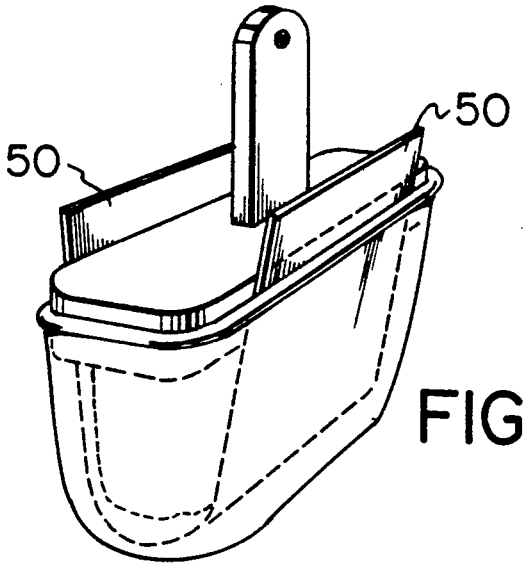
FIGS. 9 and 10 are side views similar to FIG. 2 illustrating aids to facilitate inserting the brush into the bag.
Figure 10:
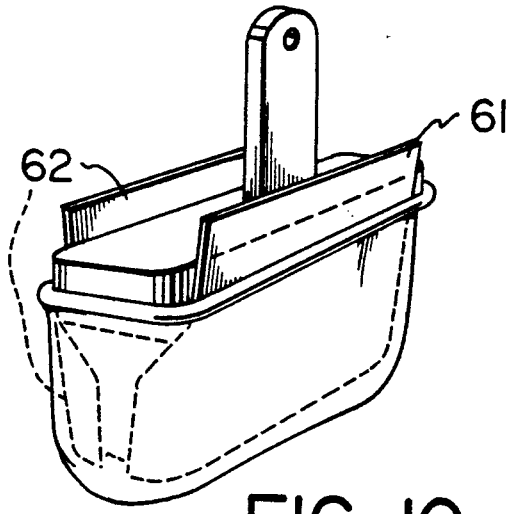

If desired a removable slip strip or removable plates may be used to place the bag on a bristle type brush. In FIG. 9 there is illustrated a pullout strip 50 of thin film plastics material. The strip placed around the end of the bristles facilitates inserting the brush into the bag after which one free end of the strip can be grasped and pulled on to remove the strip. There is however some dislocation of the bristles resulting from pulling out the strip. This is overcome by an insertion device illustrated in FIG. 10 which consists of a pair of scoop shaped thin plates 61 and 62. These plates confine the bristles between them while inserting the brush into the bag and thereafter they are readily physically slid out by pulling on the free end located exterior of the bag. The thin plates may be plastic, metal, card board or the like.

Figure 2:
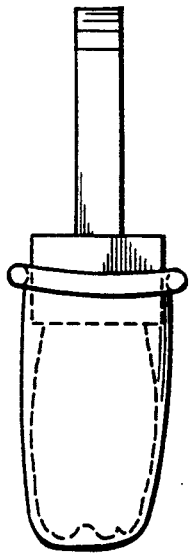
FIG. 2 is a side elevational view of FIG. 1.
Figure 11:
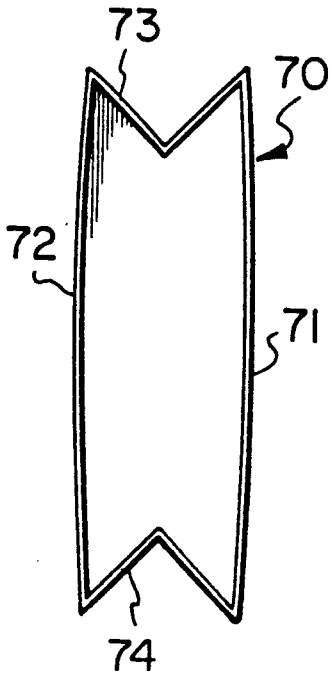
FIG. 11 is a top plan view of a sleeve type brush insertion aid.

FIG. 11 illustrates in top plan view a brush slip on open ended sleeve 70 with sides 71 and 72 corresponding to respective plates 61 and 62 of FIG. 2. The sides 71 and 72 are joined by folded opposite end walls or connections 73 and 74.

I claim:

1. An open top bag for a brush coating applicator and a readily removable aid facilitating insertion of a bristle type brush into the bag, said bag conforming in shape to the bristle portion of the brush and having means at said open top thereof detachably to secure the bag to the head of the brush.

2. A coating applicator as defined in claim 1 wherein said bag has a thickened position around the opening thereof, said thickened portion being detachably attachable securely to the head of the brush and serving as a drip collar for the coating applicator.

3. A coating applicator as defined in claim 1 wherein said bag is made from synthetic yarn material.

4. A coating applicator as defined in claim 3 wherein said cloth is of the stretch type.

5. A coating applicator as defined in claim 1 wherein said form fitting bag has a rolled top edge and including adjustable means for tightening the open end of the bag onto the head of the brush.

6. The apparatus of claim 1 wherein said aid comprises a thin film strip.

7. The apparatus of claim 1 wherein said aid comprises a pair of thin plates.

8. The apparatus of claim 7 wherein said plates are each scoop like in shape.

9. The apparatus of claim 1 wherein said aid comprises an open ended sleeve having a pair of opposite side walls connected one to the other by opposite end walls having at least one fold therein.

* * * * *